United States Patent [19]

Mellon et al.

[11] 4,433,712

[45] Feb. 28, 1984

[54] INSULATING DEVICE FOR IMPEDING HEAT FLOW

[75] Inventors: Timothy Mellon, Guilford; Gustaf B. Carlson, Haddam, both of Conn.

[73] Assignee: Independent Systems Corporation, Durham, Conn.

[21] Appl. No.: 215,427

[22] Filed: Dec. 11, 1980

[51] Int. Cl.[3] ..... A47H 1/00

[52] U.S. Cl. ..... 160/122

[58] Field of Search ..... 160/85, 120, 121, 122, 160/238

[56] References Cited

U.S. PATENT DOCUMENTS

| | | | |
|---|---|---|---|
| 2,349,368 | 5/1944 | Myers | 160/85 |
| 4,039,019 | 8/1977 | Hopper | 160/121 |
| 4,079,772 | 3/1978 | Klaenhammer et al. | 160/238 |
| 4,187,896 | 2/1980 | Shore | 160/121 |

*Primary Examiner*—Peter M. Caun

*Attorney, Agent, or Firm*—Robert D. Yeager; Andrew J. Cornelius

[57] ABSTRACT

An insulating device reduces heat transfer through a barrier—such as a wall, window, door, floor, or ceiling of a building—and into an area adjacent to the device. The insulating device includes at least one flexible sheet supported from an area above the section of the barrier to be insulated and is attached at its free end to the barrier above that section. Accordingly, the flexible sheet is doubled back upon itself and forms an insulating air space. A second flexible sheet can be attached to the support and disposed around the exterior of the first flexible sheet and attached to the barrier above the section to be insulated. Where two flexible sheets are doubled back upon themselves in such a manner, three insulating air spaces are provided. Accordingly, the insulating device impedes conductive heat transfer across the device. At least one flexible sheet includes a material having a low emittance to reduce radiant heat transfer across the device. Apparatus is provided to prevent the formation of convective currents around the perimeter of and across the device and, therefore, prevents heat transfer across the device by convection.

18 Claims, 7 Drawing Figures

INSULATING DEVICE FOR IMPEDING HEAT FLOW

BACKGROUND OF THE INVENTION

1. Field of the Invention

The present invention relates to a device for decreasing the flow of heat through a barrier—such as a wall, window, door, or ceiling of a building—and into an area adjacent to the barrier and, in particular, to such a device having at least one flexible insulating sheet which, when the device is deployed, forms insulating air spaces and a sealed perimeter.

2. Description of the Prior Art

The high price and limited supply of energy needed to heat and cool buildings have encouraged owners and operators of buildings to seek ways of decreasing the flow of heat from or into their buildings through the barriers thereof—such as their floors, walls, ceilings, and windows.

Since much of the flow of heat into or out of a well insulated building occurs through its windows, workers in the art have developed improved shades and curtains for decreasing the flow of heat through windows. Hopper U.S. Pat. Nos. 4,039,019 and 4,194,550 and Rasmussen U.S. Pat. No. Re. 30,254 disclose, respectively, a shade and a curtain, each having thermal insulating properties. In both cases, the objective is to provide compartmentalized structures to minimize heat transmission by radiation, conduction, and convection. The Hopper patents, for example, employ multiple sheets of flexible material held in spaced-apart relationship by spacer members when the shade is extended. Rasmussen, on the other hand, uses a plurality of flexible tubular members joined along their long dimension and capable of collapsing to permit retraction of the curtain. The major problems associated with such known shades and curtains are the cost of manufacturing them and their bulk when they are in a retracted condition, respectively. Accordingly, a need exists for a shade having multiple sheets and insulating air spaces therebetween that is relatively inexpensive to manufacture and that consumes a minimum of volume when it is in its retracted position.

SUMMARY OF THE INVENTION

The present invention features a relatively simple device having multiple, spaced sheets without discrete spacers; accordingly, the manufacturing cost of the present invention is relatively low. Further, the shade construction permits it to be stored with minimal bulk.

The present invention is an insulating device for impeding the flow of heat through at least a section of a barrier and into an adjacent area. The device can be used to insulate a vertical or nonvertical barrier. The device can be of the type that is always in the operative position or of the type that can be retracted and extended.

If the device is used to insulate a vertical barrier, the insulating device has a support which is secured to the barrier above the section that is to be insulated. A flexible sheet is fixed at a first edge to the support and at a second edge to the barrier above the section to be insulated. Thus, the sheet is doubled back on itself and forms, when in the operative or extended position, an insulating air space.

If the device is retractable the support can be a roller rotatably secured to a portion of the barrier, such as the window jamb. The insulating device can be placed in the retracted position by winding the flexible sheet onto the roller, either manually or through use of a suitable motor driven system. A weight, such as a cylindrical piece of wood, can be placed on the inner surface of the flexible sheet to facilitate extension of the device. As the device is retracted or extended, the weight slides along the inner surface of the sheet. In the deployed position, the weight can cause the flexible sheet to rest on a sill, thus creating a seal which prevents convection currents from flowing beneath the weight.

The present invention can include a magnetic strip secured to a portion of the barrier, such as the window jamb, adjacent the flexible sheet and a magnet secured to the flexible sheet adjacent the magnetic strip. Preferably, strips of magnetic material are secured to each window jamb and magnet strips are secured to each edge of the flexible sheet. If the insulating device is of the type that is only used in its extended position, the magnet strips will at all times adhere to the strip of magnetic material to prevent heat from flowing around the device by convection. If the insulating device is of the type that can be extended and retracted, the magnet strip is flexible and adheres to the strip of magnetic material as the insulating device is extended to prevent heat from flowing around the device by convection. The magnetic strip is disengaged from the strip of magnetic material as the insulating device is retracted.

Preferably, the flexible sheet is a laminate of a material having low heat emittance and a fire-resistant material, such as vinyl with a fire-retardant additive. The low heat emitting material should be used on the inner surface of the sheet and the fire-resistant material should be used on the outer surface thereof.

In another embodiment of the present invention, a second flexible sheet is disposed about the exterior of the first sheet. If the device is used to insulate a vertical barrier, the first edge of the second sheet is fixed to the support and a second edge thereof is fixed to the barrier above the section of the barrier to be insulated, thus preventing convective heat transfer around the device. A guide can be secured to the barrier between the first and second sheets in spaced relationship to the support. The second sheet is physically separated from the first sheet by the guide. Accordingly, when the insulating device is in the extended or operative position, the first and second sheets form three insulating air spaces. Again, if the support is a roller, the sheets can be wound around the roller to place the device in the retracted position.

To facilitate retraction and extension of the device, a first weight can be placed on the inner surface of the first sheet and a second weight can be placed on the inner surface of the second sheet between the first and second sheets. If the device is of the type that can be retracted, the weights slide along the inner surfaces of the two sheets as the device is extended or retracted. Preferably, the second edges of the first and second sheets are secured to the barrier on opposite sides of the support to create an insulating air space and the guide is secured to the barrier below the support.

To facilitate attaching the ends of the sheets to the barrier when the insulating device is used to impede heat flow through a window, a frame can be used in conjunction with the insulating device. The frame has a head frame that encloses the support on all sides but the bottom and two U-shaped side jambs that extend from the support enclosure to the windowsill. the second edges of the first and second sheets can be secured to the head frame. The frame can also include jamb frames for sealing the edges of the sheets of the insulating device to the window jambs to prevent development of convection currents.

If the insulating device has two flexible sheets, it is preferable that the inner sheet be formed of a material having low heat emitting qualities and an outer sheet having fire-resistant qualities.

The device can, within the spirit of the present invention, have additional flexible sheets disposed around the second sheet or within any of the three insulating air spaces identified above. The number of air spaces desired dictates the number of sheets that must be included in the device.

Accordingly, the insulating device of the present invention impedes the flow of heat through a barrier and into an area adjacent thereto by convection, conduction, or radiation. Heat transfer by convection is impeded because airflow from the section of the barrier to be insulated into the adjacent area is reduced. Heat transfer by conduction is impeded by the interposition of insulating air spaces between the barrier and the adjacent area. Heat transfer by radiation is prevented by the interposition of low heat emitting materials between the barrier and the adjacent area.

Therefore, the present invention is useful for reducing heat flow from a barrier into an area adjacent thereto. The present invention is particularly useful for reducing heat flow from a window into the adjacent room of a building.

When used herein, the phrase "magnetic material" shall mean any material which can be attracted by a magnet.

BRIEF DESCRIPTION OF THE DRAWINGS

The following detailed description of the preferred embodiments can be understood better if reference is made to the attached drawings in which.

DETAILED DESCRIPTION OF THE PREFERRED EMBODIMENTS

Figure 1:
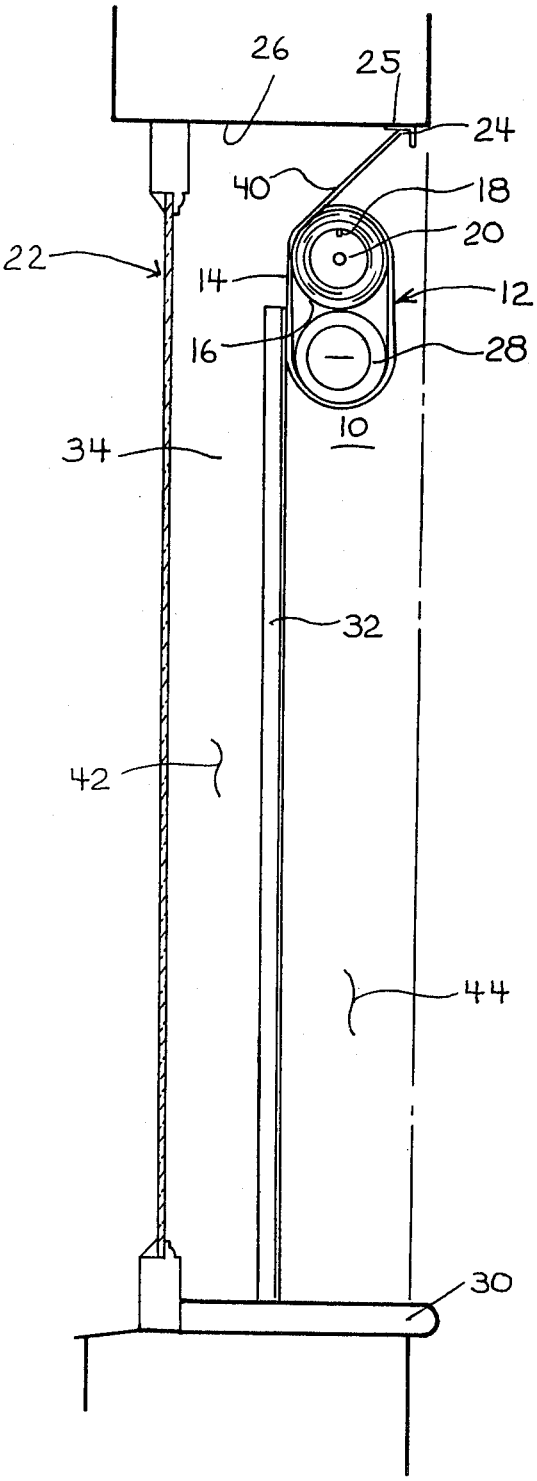
FIG. 1 is a diagrammatic side elevation view of an insulating device constructed according the provisions of the present invention in the retracted position.
Figure 2:
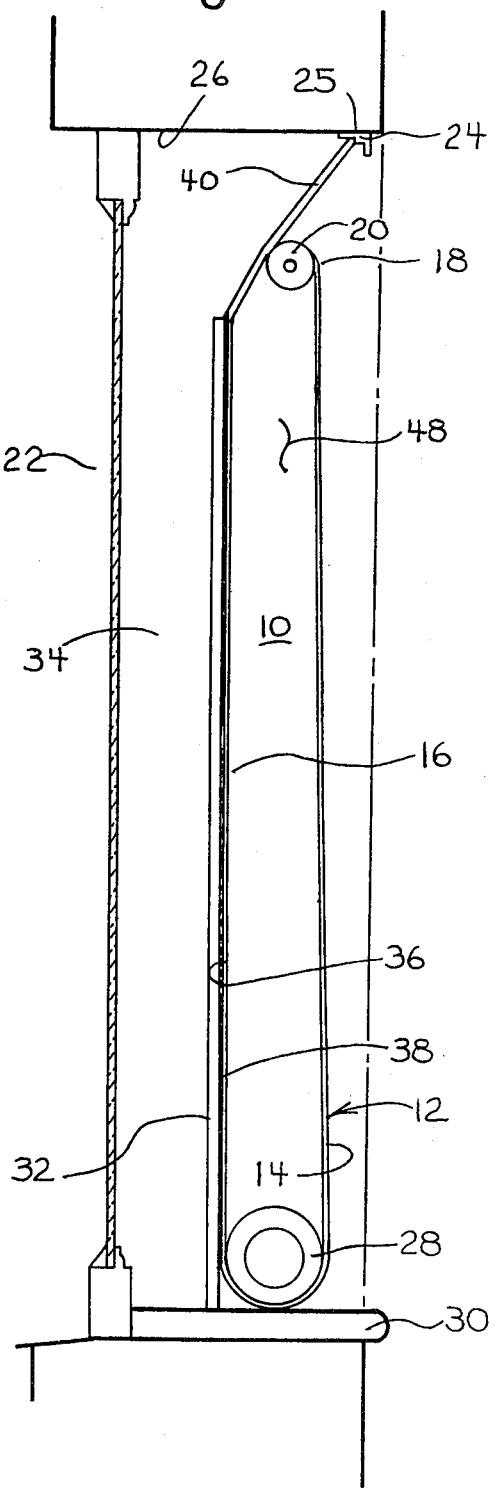
FIG. 2 is a diagrammatic side elevation view of the insulating device shown in FIG. 1 in the extended or operative position.
Figure 3:
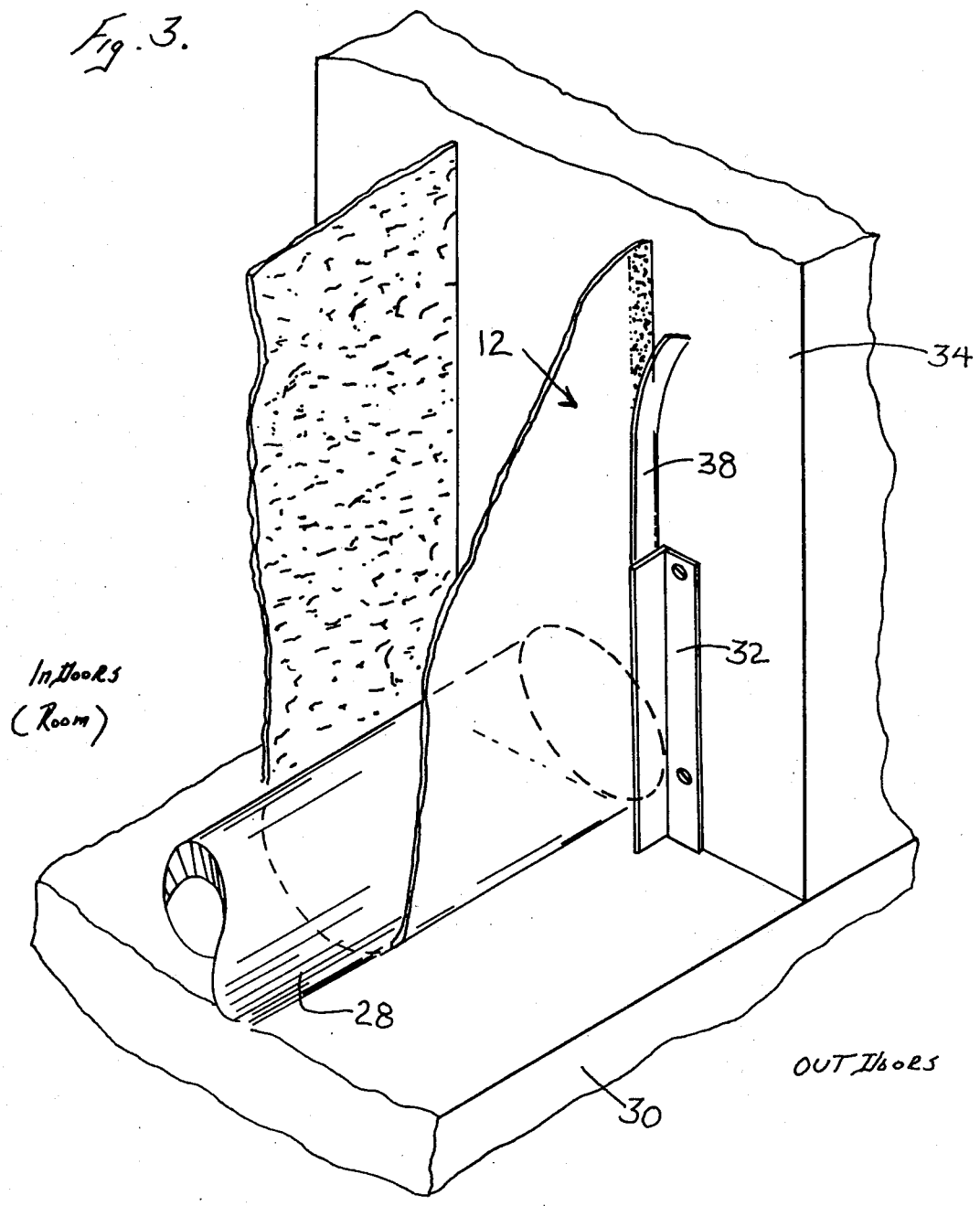
FIG. 3 is an isometric view of a portion of the device depicted in FIGS. 1 and 2.

FIGS. 1, 2, and 3 show a preferred embodiment 10 of the present invention having a single flexible sheet 12. Retractable insulating device 10 will be described below as used to impede heat flow into or from a room adjacent a window. Sheet 12 is a laminate having an outer surface 14 formed of a fire-resistant material such as vinyl with a suitable fire-retardant additive and an inner surface 16 formed of a material having a low heat emitting characteristic. The low heat emitting surface 16 prevents heat transfer through device 10 by radiation.

Insulating device 10 includes a roller 20 rotatably fixed at each end to window jamb 34 and a second jamb (not shown) of window 22. End 18 of sheet 12 is secured in any suitable fashion to roller 20. End 24 of sheet 12 is fixed to upper horizontal surface 26 of window 22 by anchor 25. A cylindrical weight 28 rests on inner surface 16 of sheet 12 and rolls therealong as insulating device 10 is retracted or deployed. When insulating device 10 is deployed to the full operative position shown in FIG. 2, weight 28 rests upon sill 30 of window 22 and prevents airflow beneath insulating device 10.

A strip of magnetic material 32 is fixed to window jamb 34 adjacent front surface 36 of sheet 12. A second magnetic strip (not shown) is fixed to the remaining window jamb (not shown) of window 22 adjacent front surface 36 of sheet 12. Magnetic strip 32 can be a length of angled magnetic material, as shown in FIG. 3. A flexible magnet strip 38 is secured adjacent magnetic strip 32 (when device 10 is deployed) to front surface 36 at each edge of sheet 12 by any suitable means. Magnet strip 38 is of a length sufficient to cover the two vertical edges of front surface 36 from roller 20 to weight 28.

Insulating device 10 can be moved from the deployed to retracted position by rotating roller 20 in the counterclockwise direction as shown in FIGS. 1 and 2 until weight 28 touches roller 20. Roller 20 can be rotated manually or by any suitable motorized system. Reversing such procedure effects deployment of insulating device 10 from the retracted position as shown in FIG. 2. As insulating device 10 is deployed from the retracted position, magnet strip 38 adheres to magnetic strip 32 on each window jamb and, with portion 40 of sheet 12 and weight 28, prevents airflow around insulating device 10. When it is in the deployed position, sheet 12 forms insulating air space 48 which prevents heat transfer through device 10 by conduction.

Figure 4:
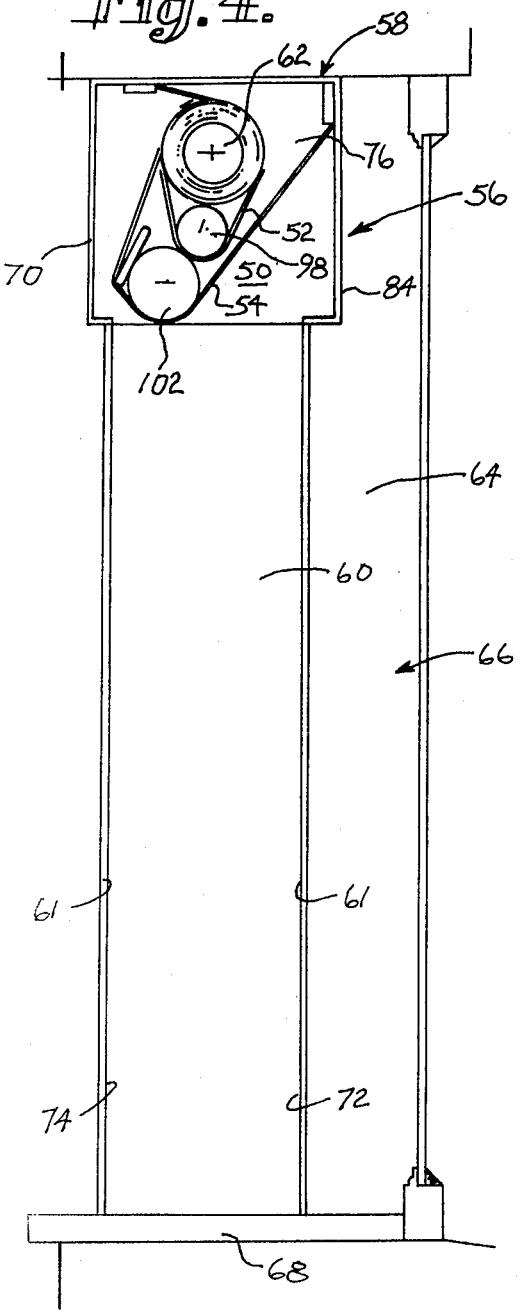
FIG. 4 is a diagrammatic side elevation view of an alternate embodiment of the present invention in the retracted position.
Figure 5:
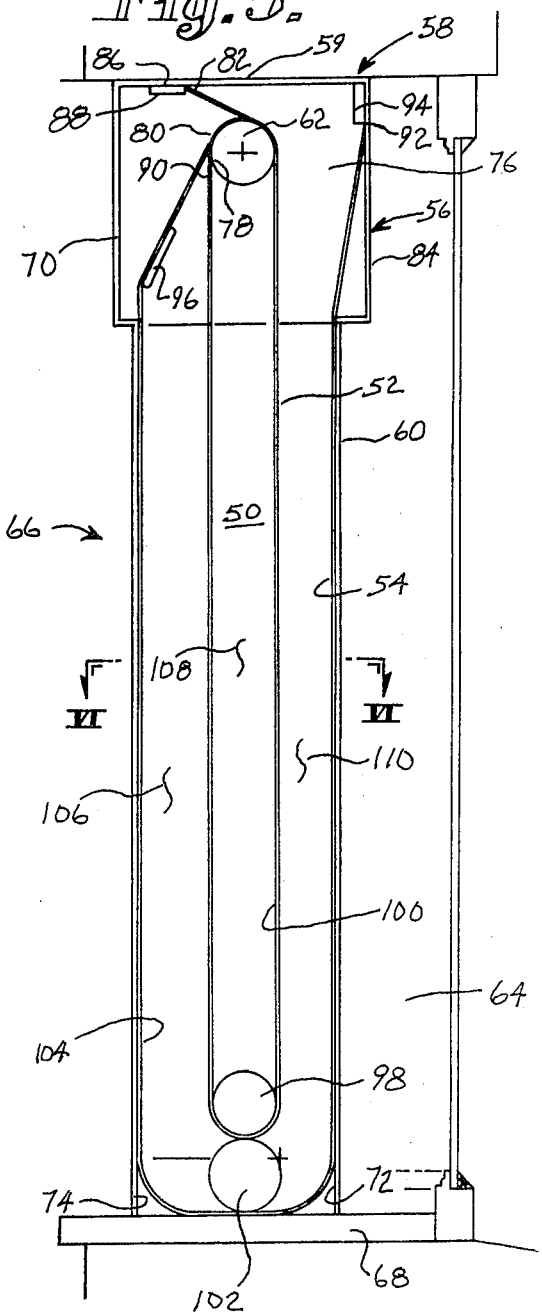
FIG. 5 is a diagrammatic side elevation view of the insulating device depicted in FIG. 4 in the extended or operative position.
Figure 6:
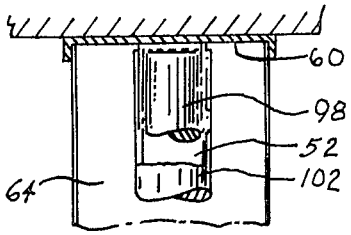
FIG. 6 is a view, partially in section, of the device shown in FIG. 5, taken along the line VI—VI.
Figure 7:
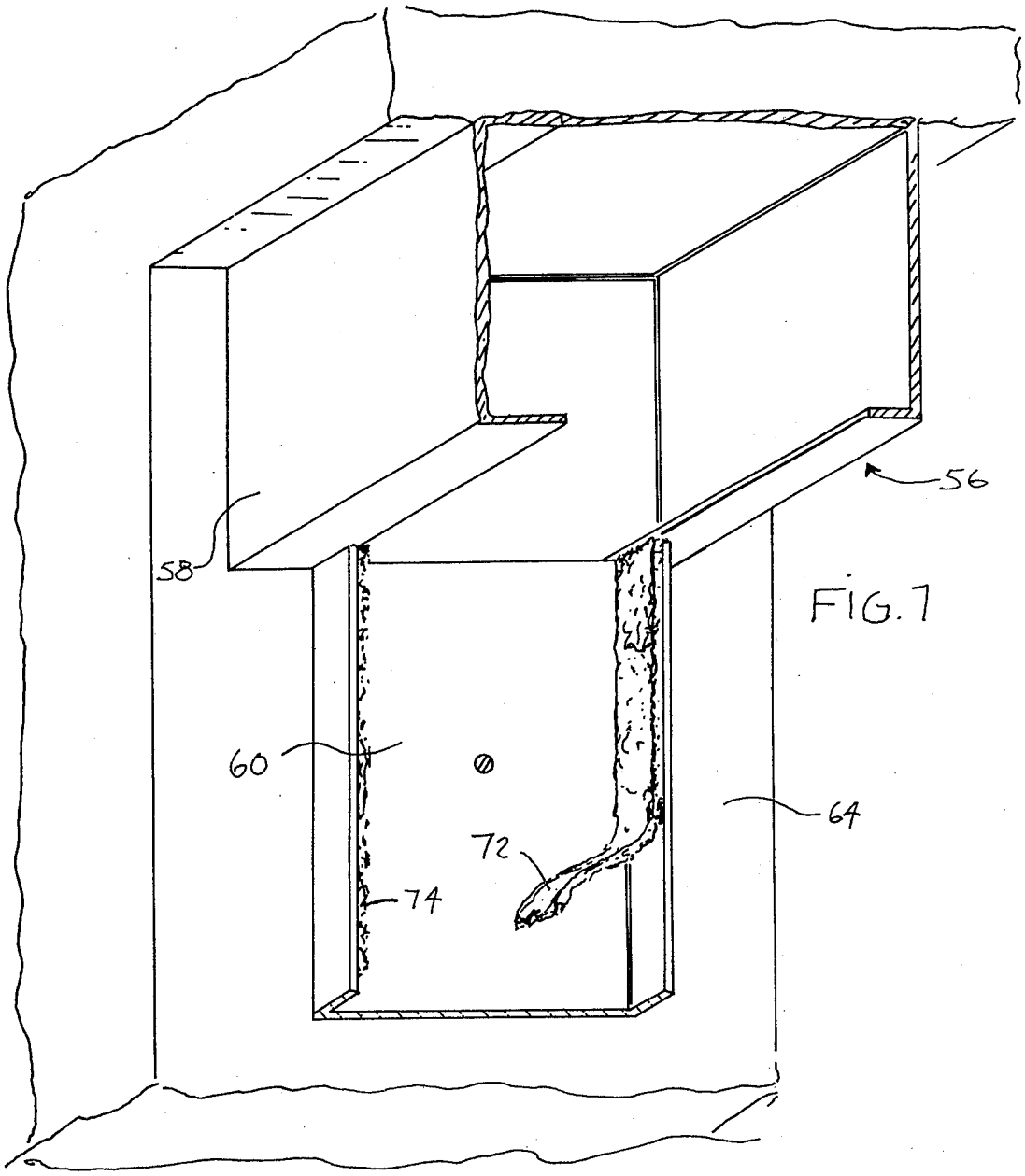
FIG. 7 is an isometric view of a portion of a frame on which the present invention can be mounted.

FIGS. 4, 5, and 6 show an alternate embodiment 50 of the present invention having two flexible sheets 52 and 54. Sheets 52 and 54 form insulating air spaces 106, 108, and 110, which prevent heat transfer through device 10 by conduction. As with insulating device 10, insulating device 50 will be described as it is used with a window. It is preferable, although not necessary, to mount insulating device 50 in frame 56 (see FIGS. 4 through 7). Alternately, insulating device 50 can be mounted in any suitable fashion above a window. Frame 56 is constructed from a poor heat conductor to further impede heat transfer through insulating device 50. Frame 56 includes head frame 58, jamb frame 60 secured to window jamb 64 and a second jamb frame (not shown) secured to the remaining window jamb of window 66. Head frame 58 encloses roller 62 of insulating device 50 on all sides but the bottom. The two ends of head frame 50 are secured to window jamb 64 of window 66 and to the remaining window jamb of window 66 that is not shown. Jamb frame 60 is fixed to window jamb 64 and to head frame 58 as shown in FIGS. 4 and 5. Jamb frame 60 extends from head frame 58 to sill 68 and prevents airflow around the free vertical edges of sheets 52 and 54. Head frame 58 can be constructed to permit removal of section 70 and permit access to roller 62. Soft seals 72 and 74, which are made of any suitable heat-insulating material, are fixed to the inner surfaces 61 of jamb frame 60 and the jamb frame not shown to hold the free edges of sheets 52 and 54 in place and to further prevent airflow therearound.

The ends of roller 62 are rotatably secured to section 76 of head frame 58 and to the corresponding end of frame 56 that is not shown in FIG. 4 or 5. End 78 of sheet 52 is fixed to roller 62 at point 80 thereof. End 82 of sheet 52 is fixed to section 59 of head frame 58 at point 86 by any suitable means such as by anchor 88. End 90 of sheet 54 is fixed to roller 62 at point 80. End 92 of sheet 54 is fixed to section 84 of head frame 58 in any suitable fashion as with anchor 94. A guide 96 is fixed at either end thereof to section 76 of head frame 58 and to the corresponding section thereof not shown. Guide 96 is disposed between sheets 52 and 54 and defines the separation distance therebetween. Weight 98 rests on inner surface 100 of sheet 52 and slides thereon as insulating device 50 is deployed or retracted. Similarly, weight 102 is placed on surface 104 of sheet 54 and slides thereon as insulating device 50 is deployed or retracted. Weights 98 and 102 serve to restrict the mobility of sheets 52 and 54 and better define insulating air spaces 106, 108, and 110. The dimensions of weights 98 and 102 should be chosen to provide air spaces 106, 108, and 110 having a depth of 0.75 to 1.00 inches.

Insulating device 50 can be deployed or retracted in the same manner as insulating device 10. As insulating device 50 is deployed or retracted weights 98 and 102 are drawn toward roller 62 and slide on inner surfaces 100 and 104 of sheets 52 and 54 respectively.

Preferably, sheet 52 is made of a material having a low emittance to prevent heat transfer through insulating device 50 by radiation and sheet 54 is made of a fire-resistant material such as vinyl with a fire-retardant additive.

What is claimed is:

1. Apparatus for reducing the amount of heat introduced into or leaving a space through a barrier comprising:

a support member secured to the barrier; and a flexible sheet adjoining the space and formed of a material having a low heat-emitting surface fixed at one edge to said support and at a second edge to a mounting at a location spaced from the location at which said one edge is fixed to said support, said sheet adapted to cooperate with the barrier and said support to create an air-filled chamber that prevents the flow of air to or from the space and to or from the interior of said chamber through the barrier, that retards heat flow by conduction to or from the space through the barrier, and that blocks the path of radiant energy directed at the space through the barrier.

2. The insulating device recited in claim 1 wherein said support member is a roller rotatably secured to said barrier upon which said sheet can be wound.

3. The insulating device recited in claim 2 further comprising a weight slidably resting on the inner surface of said sheet.

4. The insulating device recited in claim 3 wherein said weight is cylindrical in shape and has a length equal to the width of said sheet.

5. The insulating device recited in claim 3 further comprising a strip of magnetic material secured to said barrier adjacent said sheet and a magnet strip secured to said sheet adjacent said strip of magnetic material when said device is deployed, said magnet strip adhering to said strip of magnetic material as said insulating device is deployed and becoming disengaged from said strip of magnetic material as said insulating device is retracted.

6. The insulating device recited in claim 1 wherein said sheet is a laminate of a low heat emitting material and a fire-resistant material.

7. The insulating device recited in claim 6 wherein said fire-resistant material is vinyl with a fire-retardant additive.

8. The apparatus recited in claim 1 further comprising:

at least a second flexible sheet disposed outside said air-filled chamber having a first edge fixed to said support and a second edge fixed to a mounting at a location spaced from the location at which said first edge is fixed to said support;

a guide secured to said barrier between said first and second sheets and in spaced relationship to said support; and said first and second sheets forming three insulating air-filled chambers when said apparatus is in the deployed position.

9. The insulating device recited in claim 8 further comprising a seal formed of a heat-insulating material secured to said barrier that engages the free edges of said sheets when said device is deployed and prevents heat transfer by convection around said sheets.

10. The insulating device recited in claim 8 wherein said support is a roller rotatably secured to said barrier upon which said sheets can be wound.

11. The insulating device recited in claim 10 further comprising:

a first weight slidably resting on the inner surface of said first sheet; and a second weight slidably resting on the inner surface of said second sheet between said first and second sheets.

12. The insulating device recited in claim 11 wherein said weights are cylindrical in shape and have lengths equal to the width of said sheets.

13. The insulating device recited in claim 8 wherein said second edges of said first and second sheets are secured to said barrier on opposite sides of said support.

14. The insulating device recited in claim 8 wherein said guide is disposed below said support.

15. The insulating device recited in claim 8 wherein said first sheet is formed from low heat emitting material and said second sheet is formed from fire-resistant material.

16. The insulating device recited in claim 15 wherein said fire-resistant material is vinyl with a fire-retardant additive.

17. An insulating device for impeding the flow of heat through at least a portion of a barrier comprising:

a roller rotatably secured to said barrier above said section;

a flexible sheet formed of a material having a low heat-emitting surface and fixed at a first edge thereof to said roller and at a second edge thereof to said barrier above said section at a location spaced from the location at which said first edge is fixed to said roller, said sheet forming an insulating air space when said insulating device is in the deployed position;

a weight slidably resting on the inner surface of said sheet;

a strip of magnetic material secured to said sheet adjacent said sheet; and a magnet strip secured to said sheet adjacent said strip of magnetic material when said device is deployed, said magnet strip adhering to said strip of magnetic material as said insulating device is deployed and becoming disengaged from said strip of magnetic material as said insulating device is retracted.

18. Apparatus for reducing the amount of heat introduced into or leaving a space through a barrier comprising:

a support member secured to the barrier;

a flexible sheet adjoining the space fixed at one edge to said support and at a second edge to a mounting at a location spaced from the location at which said one edge is fixed to said support, said sheet adapted to cooperate with the barrier and said support to create an air-filled chamber that prevents the flow of air to or from the space and to or from the interior of said chamber through the barrier, that retards heat flow by conduction to or from the space through the barrier, and that blocks the path of radiant energy directed at the space through the barrier;

a second flexible sheet fixed at one edge to said support and at a second edge to a mounting at a location spaced from the locations at which said one edges of said flexible sheets are fixed to said support, one surface of said second flexible sheet confronting a surface of said first flexible sheet;

at least one surface of said first sheet or said second sheet including a low heat-emitting surface;

means for maintaining a spaced apart relationship between those portions of said sheets deployed for normal operation; and said second sheet cooperating with said first sheet, said support, and said barrier to form second and third said air-filled chambers.

* * * * *

UNITED STATES PATENT AND TRADEMARK OFFICE

CERTIFICATE OF CORRECTION

PATENT NO. : 4,433,712

DATED : February 28, 1984

INVENTOR(S) : Timothy Mellon et al.

It is certified that error appears in the above-identified patent and that said Letters Patent is hereby corrected as shown below:

Column 2, line 27, "magnetic" should read -- magnet --.

Column 3, line 1, "the", third occurrence, should read -- The --.

Signed and Sealed this

*Twenty-ninth* Day of *January 1985*

[SEAL]

*Attest:*

DONALD J. QUIGG

*Attesting Officer*

*Acting Commissioner of Patents and Trademarks*